United States Patent [19]

Landers

[11] Patent Number: 4,694,661

[45] Date of Patent: Sep. 22, 1987

[54] ICE DISPENSER WITH AN UPWARDLY INCLINED CHANNELED RAMP AND TWO PART AUGER

[75] Inventor: Jerry L. Landers, Sellersburg, Ind.

[73] Assignee: Servend International, Inc., Jeffersonville, Ind.

[21] Appl. No.: 823,925

[22] Filed: Jan. 23, 1986

[51] Int. Cl.[4] ..... F25C 5/18

[52] U.S. Cl. ..... 62/344; 222/146.6; 222/413; 366/318; 366/320; 366/329

[58] Field of Search ..... 62/344, 343; 222/146.6, 222/412, 413; 366/318, 320, 329

[56] References Cited

U.S. PATENT DOCUMENTS

| | | | |
|---|---|---|---|
| 824,075 | 6/1906 | Gerner | 62/343 X |
| 2,587,127 | 2/1952 | Erickson et al. | 366/329 X |
| 3,249,342 | 5/1966 | Mikkelson | 366/329 X |
| 3,641,783 | 2/1972 | Werner | 62/343 |
| 3,798,923 | 3/1974 | Pink et al. | 62/344 X |
| 3,858,765 | 1/1975 | Landers | 222/146.6 X |
| 3,902,331 | 9/1975 | True, Jr. et al. | 62/344 X |
| 4,512,502 | 4/1985 | Landers | 222/413 |

FOREIGN PATENT DOCUMENTS

| | | | |
|---|---|---|---|
| 883642 | 10/1971 | Canada | 222/413 |

*Primary Examiner*—William E. Tapolcai
*Attorney, Agent, or Firm*—James C. Wray

[57] ABSTRACT

Effective active storage volume of an ice dispenser is increased by an upward and forward sloping bottom wall with a compound curve. A stainless steel helically bent auger rod has a conical shape and closely fits within a trough having a relatively large radius at a rear and a relatively small radius at a front. Larger radius curved lateral areas complete the bottom wall. Ice moves upward toward the front of the bin and then upward at an obtuse angle toward the top of the bin and then tumbles rearward and downward. The rotating auger prevents bridging and continually pushes more ice forward than is dispensed. A helical auger with solid flytes radially extends from a forward portion of the shaft to move ice cubes through the dispensing opening in the front wall at the front end of the trough.

25 Claims, 5 Drawing Figures

ICE DISPENSER WITH AN UPWARDLY INCLINED CHANNELED RAMP AND TWO PART AUGER

BACKGROUND 0F THE INVENTION

This invention relates to ice dispensing machines and to the improving of storage capacity and the improving of delivery of ice.

Ice dispensers of the storage bin type are well-known. Such devices often have helical augers which move ice towards a dispensing area. Sometimes circulating augers and dispensing augers are used conjointly.

It is highly desireable that ice circulate in the bin so that it does not form solid blocks or frozen clusters of ice cubes which may prevent dispensing.

One problem that occurs in ice cube dispensers is the bridging of ice cubes or the forming of a frozen bridge of ice cubes above augers or other conveyors. Another problem that may be encountered with ice dispensers is that ice clusters, although free to move, may block dispensing openings.

Another problem with ice dispensers is that the entire volume of the storage bin often is used ineffectively, e.g., in some ice bins, ice will accumulate only near the front or dispensing part of the bin. The space in the rear of the bin may be devoid of ice. That may be particularly noticeable when ice is added from the front of the top of the bin either by emptying containers of ice cubes into the bin or by discharging ice cubes from ice-making machines mounted atop the bin. Ice machines typically rest on top of the dispenser and discharge their production if ice cubes into the front of the ice machine. When the dispenser senses that the ice bin is full, by sensing accummulation at the front of the machine, the ice machine is shut off. When the rear of the bin is empty but the front of the bin is full, the ice machine is shut off prematurely.

Two of the inventors, U.S. Pat. Nos. 3,858,765 and 4,512,502, describe and claim ice dispensing apparatus and methods.

SUMMARY OF THE INVENTION

Effective active storage volume of an ice dispenser is increased by an upward and forward sloping bottom wall with a compound curve.

A stainless steel helically bent auger rod has a conical shape and closely fits within a trough having a relatively large radius at a rear and a relatively small radius at a front. Larger radius curved lateral areas complete the bottom wall. Ice moves upward toward the front of the bin and then upward at about 115 degrees toward the top of the bin and then tumbles rearward and downward. The rotating auger prevents bridging and continually pushes more ice forward than is dispensed. A helical auger with solid flytes radially extends from a forward portion of the shaft to move ice cubes through the dispensing opening in the front wall at the front end of the trough.

The present ice bin has a unique bottom wall.

The shape of the front bin wall is smaller but is similar to the larger relative shape of the rear bin wall. The front and rear bin walls are adjoined by the side wall and the bottom wall of the bin. The latter slopes downward from the front wall to the rear wall. Located in the bottom center of the front wall is an opening through which the ice is dispensed.

Located in the bottom center of the hopper is a trough which is curved with a size related to the diameter of a cone shaped wire auger which is used for the dispensing and agitation of the ice in the bin. The trough provides a channel in which the ice moves in a controlled, positive manner to the dispensing opening.

An auger used for the dispensing of ice is angularly mounted between the front and rear wall. The auger has two functions: the pushing of ice from the rear to the front of the hopper for ice dispensing, and the agitation of ice within the bin. The rear portion of the auger consists of a stainless steel rod framed in a cone shape connected to a solid flyte which is the front portion of the auger.

The bottom portion of the auger lies within the bin trough. The function of the bottom half of the auger is ice dispensing. The top portion of the auger agitates the ice in the bin.

Due to the cone shape of the auger, more ice is pushed toward the dispensing opening than will dispense out the opening. Due to the shape of the bin, the excess ice that does not dispense pushes against the front bin wall, and climbs upward at an approximate angle of 115 degrees. The ice climbs at this angle due to the uphill push of the ice within an angularly inclined bin. When the ice reaches its climbing apex, it tumbles toward the rear of the hopper where a void has been created by the larger rear flyte of the cone shaped auger. This circular motion of the agitated ice continues until the bin is emptied.

The primary benefit of the bin shape is the additional ice storage that is gained from the downwardly sloping bin as opposed to standard ice dispensing bins in which the bottom rear of the hopper is on the same horizontal plane as the bottom front of the hopper. Additional ice storage is desireable within a given shape because of the value achieved in providing more product capability in that given space. The only alternative to the present invention is to increase height, depth, or width of an existing ice bin. Such an increase is inefficient when compared to the present invention. Maximization of space relative to the height of the machine is especially helpful in manually loading countertop ice dispensers.

The allowable bin angle in the proposed invention results in a substantial increase in storage compared to standard ice dispensing bins.

A further novelty of the proposed invention is the utilization of a wire auger to dispense and to agitate and to move ice uphill.

Secondary benefits of the bin shape are derived from the manner in which commercial ice machines harvest their ice production in the front of the ice machine. The ice machines typically rest on the top of the dispensers and discontinue ice production when sensing that the ice bin is full. An ice machine that has front harvest (approximately 80% of the 1985 market) has a tendency to shut off prematurely, because it senses that the bin is full, when in fact the ice level is sloped to the rear, thus leaving a portion of the bin empty. The present invention allows a fuller bin by depositing the ice production in the lower rear portion of the bin before the front of the bin is full.

This invention provides an ice storage bin in an ice dispenser which has a rear wall, a front wall, and side walls which are connected to the rear and front walls and a cover means which rests atop the rear front and side walls and a lower wall extending between the rear wall, front wall and side walls. The lower wall slopes upwardly from the rear wall to the front wall. A dispensing opening at an intersection of the front wall and the bottom wall dispenses ice which has been stored within the bin.

In the preferred apparatus the bottom wall forms an obtuse angle with the front wall.

Preferably, the bottom wall is curved.

The preferred bottom wall is curved downward from relatively high positions on the side wall to relatively low positions intermediate the side walls.

Preferably, the bottom wall is constructed of curves having different radii.

In a preferred embodiment, the bottom wall has a central trough with a relatively large radius of curvature near the rearward wall and a relatively small radius of curvature near the forward wall.

The preferred bottom wall has lateral portions with generally uniform radii of curvature which extend from the central trough to the side walls and which slope upward from the rear wall to the front wall.

The preferred central trough forms a larger obtuse angle with a plane of the front wall, and the lateral sections form lesser obtuse angles with a plane of the front wall.

Preferably, the dispensing opening is formed in the front wall adjacent a forward edge of the central section.

In a preferred embodiment, the dispensing opening has a straight lower edge and generally vertical, lateral edges extending upward from lateral extremities of the lower edges.

In one embodiment, spaced openings of the bottom wall permit ice cubes to fall for chilling a cold plate mounted beneath the bottom wall.

In a preferred embodiment, a rotatable shaft has a rearward end mounted on the rear wall and has a forward end extending through the ice dispensing opening.

Preferably, a rearward end of the shaft is mounted in a journal bearing on the rear wall and a driving means is connected to a forward end of the shaft.

Preferably, the shaft slopes upward from the rear wall.

In a preferred apparatus, the rear wall has a lower portion which slopes inward generally perpendicular to the shaft.

A preferred auger has radial extensions mounted at spaced intervals along the shaft. The radial extensions are relatively long near the rearward end of the shaft and uniformly diminish to relatively short radial extensions. A stainless steel rod is bent in a helical shape with overall generally conical dimensions, forming continuously connected flytes having generally large radii near a rearward end of the shaft and having generally smaller radii as the flytes extend along the shaft.

In a preferred embodiment, a solid, helical auger having generally oppositely radially extending flytes is mounted on the shaft adjacent its forward end.

In another preferred embodiment, the auger comprises a coil having spaced spirals which taper in diameter from one end to the other. At about midpoint along the length of the coil, the wire forming the larger spirals is bent towards the center of the coil. At the center of the coil the wire is bent again in an axial direction away from the larger spirals where the wire acts as a central shaft around which is wound a ribbon like wire forming smaller spirals.

Preferably, the wire rod closely approaches the central section of the bottom wall.

Preferably, the bottom wall is formed of a compound, curved sheet, and the bin is positioned upon a base.

In one preferred embodiment, a shaft is mounted above the bottom wall and extends between the rear wall and front wall. A rod-type auger, supported on radial extensions from the shaft, uniformly decreases in radius from a large diameter near the rear wall to a smaller diameter near the front wall, and a blade-type auger extends generally radially in opposite directions from the shaft near the front wall.

The preferred method of moving ice in a storage bin comprises moving ice forward and upward along a sloping bottom wall and the moving ice upward and tumbling ice rearward and downward in the bin.

In the preferred method, the moving of the ice comprises turning an auger mounted on a shaft spaced upward from the sloped bottom wall.

These and further and other objects and features of the invention are apparent in the disclosure which includes the above and ongoing specification and claims and drawings.

DETAILED DESCRIPTION OF THE DRAWINGS

Figure 1:
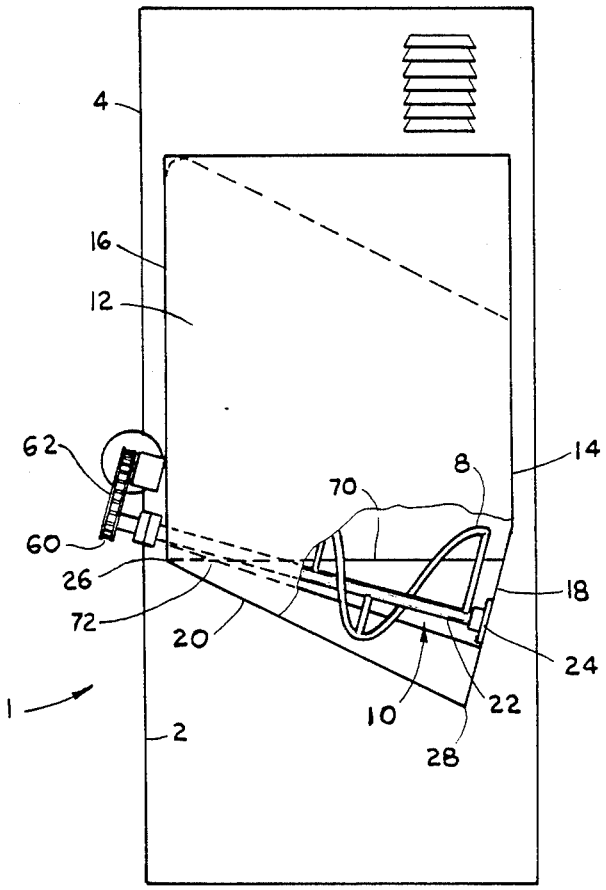
FIG. 1 is a side elevation of the apparatus of the present invention.

Referring to FIG. 1, an ice dispensing bin of the present invention is generally referred to by the numeral 1. Ice bin 1 is mounted on a base 2 to position the dispensing opening in the ice bin at the desired vertical position. As shown in FIG. 1, an ice-making machine 4 is mounted on top of ice bin 1. An auger 8 is mounted on a shaft 10 at the bottom of the ice bin to circulate ice in the ice bin and to move ice toward the dispensing opening.

Figure 2:
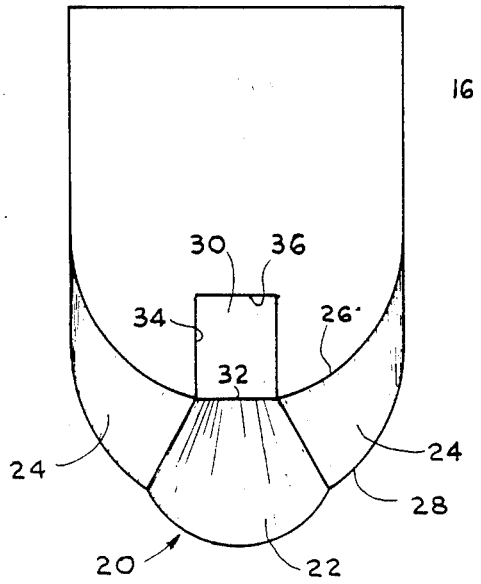
FIG. 2 is a rear elevation showing the bottom wall and front wall and ice dispensing opening.

The ice bin is made of side walls 12, rear wall 14, front wall 16 and forward sloping lower portion 18 of the rear wall 14 and a compound curved bottom wall 20 which is best understood with reference to FIG. 2.

As shown in FIG. 2, the compound curved bottom wall 20 has a central trough area 22 and curved lateral areas 24. Line 26 shows where the compound curved bottom wall 20 joins the front wall 16, and line 28 is the junction of the compound curved bottom wall 20 with the lower inward sloping portion 18 of the rear wall 14.

An ice dispensing opening 30 in front wall 16 has a flat lower edge 32, and rectangularly oriented side edges 34 and top edge 36.

In preferred embodiments, the trough forms a partial conical shape having a relatively large radius where it joins the rear wall portion 18 and having a relatively small radius at the lower edge of the ice dispensing opening.

The imaginary axis of the conical cross-section 22 slopes upward, and the bottom of the trough slopes upward at an angle of about 30 degrees.

The curved side areas 24 of the bottom wall 20 are generally partially cylindrical in shape and slope upward from the rear wall at an angle slightly less than the angle of upward slope of the trough portion 22.

Figure 3:
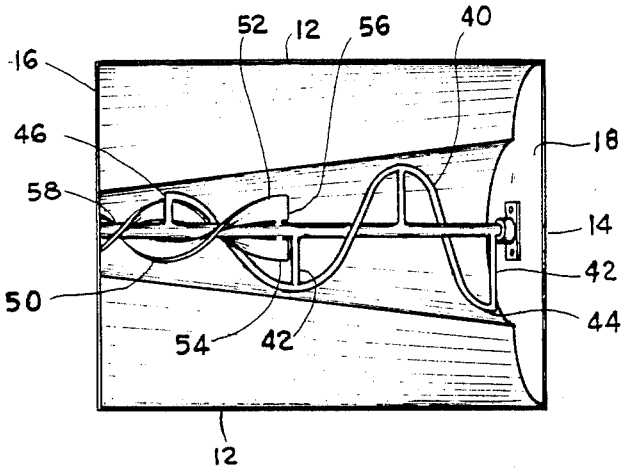
FIG. 3 is a plan view showing the bottom wall and auger.

The preferred auger is described with reference to FIGS. 1–3. Preferably the shaft 10 is mounted along the imaginary axis of the conical trough or slightly above the axis. A stainless steel rod 40 bent in the shape of a helix and having an overall conical shape is mounted on radial struts 42 which extend oppositely from shaft 10. Flytes of the auger rod have about ½ inch clearance with the inside wall of the trough section 22 of the bottom wall.

The rearward end 44 of the rod auger 40 is close to the sloped rear wall 18. The forward end 46 of the wire rod is spaced inward from the front wall.

Also mounted on shaft 10 is solid flyte auger 50 which has blades 52 and 54 extending in opposite directions from the shaft. The rearward end 56 of the solid flyte auger 50 is about one third of the distance between the front wall and the rearward wall. The forward end 58 of the solid flyte auger is near the dispensing opening 30. Alternatively, the solid flyte auger may extend through the dispensing opening.

Figure 4:
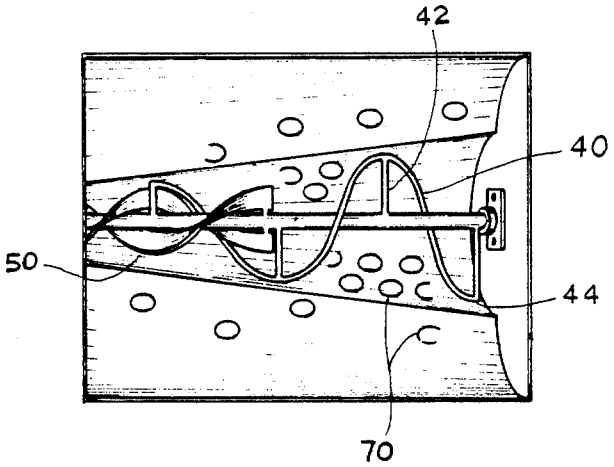
FIG. 4 is a plan view showing a modified form of the invention.
Figure 5:
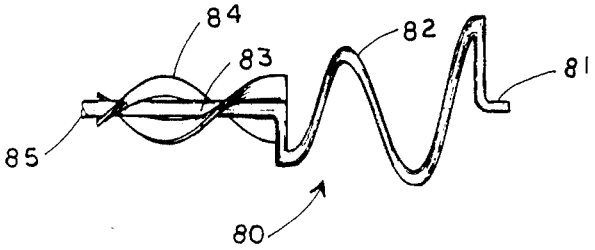
FIG. 5 is a plan view of the auger of FIG. 4.

Another preferred embodiment of the auger is disclosed in FIG. 5. The principal advantages of this style of auger is the economy of materials needed to manufacture this auger. As in the embodiments of FIGS. 3 and 4, the auger of FIG. 5 is a coil having spirals taper from end 81 to end 85. The wire 82 forming the larger spirals becomes straightened towards end 85 into central shaft 83. Smaller blade like spirals are wound around the central shaft 83. The smaller spirals 84 are made from ribbon like wire forming blade like radial extensions from central shaft 83. The blade like spirals maximize the urging of ice towards the dispensing opening near a shaft journal for end 85.

The front end of the shaft 10 has a sprocket 60. Chain 62 driven by a motor mounted along a lower side of the bin drives the auger when a switch is turned on to drive the auger.

As shown in FIG. 4, holes 70 in the bottom wall of the cold plate 22 permit ice cubes to drop through the bottom wall to cool a cold plate which is mounted beneath the trough.

The present invention because of the unique shape of the bottom wall of the bin and the unique auger is capable of storing and dispensing about 30% more ice than a bin of similar lateral, vertical, and longitudinal dimensions with a flat bottom wall as shown by the dash line 72 in FIG. 1. The unique shape of the auger in combination with the unique compound curved shape of the bottom wall forces more ice forward toward the front wall than the dispensing opening is capable of passing. Due to the obtuse angles that the trough section and the lateral sections of the bottom wall make with the front wall, the excess ice is pushed upward, usually at an angle of about 115 degrees, lifting ice above the ice pushed by the auger. That ice moves upward and then tumbles rearward. With each operation of the auger, ice within the bin climbs and circles backward. The sloped climbing and circling motion which is apparent in operation of the present invention is not affected by dispensing machines which have flat or curved bottom walls without an upward and forward slope. The climbing and circling encourages ice at the front of the present machine to move rearward, carrying rearward the ice manufactured by the above-mounted ice-making machine 4.

The unique slope of the bottom wall and the unique shape and mounting of the auger provide more dispensable ice storage. The present invention is able to move about 96% of ice stored within the bin out through the dispensing opening 30. The ice dispenser of the present invention provides increased storage capacity, increased dispensability of stored ice within a given space, and provides a dispenser which is completely serviceable from the front.

The unique shape and inclination of the wire auger circulates ice in the bin, breaks up any agglomeration of ice cubes and dispenses the ice in a recognizable form.

While the invention has been described with reference to specific embodiments, modifications and variations of the invention may be constructed without departing from the scope of the invention. The scope of the invention is defined in the following claims.

I claim:

1. An ice storage bin in an ice dispenser has a rear wall, a front wall, and side walls which are connected to the rear and front walls and a cover means which rests atop the rear, front and side walls and has a bottom wall extending between the rear wall, front wall and side walls, the bottom wall curving downward from relatively high positions on the side walls to relatively low positions intermediate the side walls and sloping upwardly from the rear wall to the front wall and a dispensing opening in the bin for dispensing ice stored within the bin the bottom wall being constructed of curves having different radii.

2. The apparatus of claim 1 wherein the bottom wall has a central section with a relatively large radius of curvature near the rear wall and a relatively small radius of curvature near the front wall.

3. The apparatus of claim 1 wherein the bottom wall is formed of a sheet and is positioned upon a base of the bin.

4. The apparatus of claim 1 further comprising a shaft mounted above the bottom wall and extending between the rear wall and front wall, radial struts extending from the shaft and a rod-type auger supported on the radial struts, the rod-type auger uniformly decreasing in radius from a large diameter near the rear wall to a smaller diameter near the front wall.

5. An ice storage bin in an ice dispenser has a rear wall, a front wall, and side walls which are connected to the rear and front walls and a cover means which rests atop the rear, front and side walls and a bottom wall extending between the rear wall, front wall and side walls, the bottom wall curving downward from relatively high positions on the side walls to relatively low positions intermediate the side walls and sloping upwardly from the rear wall to the front wall and a dispensing opening in the bin for dispensing ice stored within the bin, wherein the bottom wall has a central section with a relatively large radius of curvature near the rear wall and a relatively small radius of curvature near the front wall, and wherein the bottom wall has lateral portions with generally uniform radii of curvature which extend from the central section to the side walls and which slope upward from the rear wall to the front wall.

6. The apparatus of claim 5 wherein the central section forms a larger obtuse angle with a plane of the front wall and wherein the lateral portions form lesser obtuse angles with a plane of the front wall.

7. The apparatus of claim 6 wherein the dispensing opening is formed in the front wall adjacent a forward edge of the central section.

8. The apparatus of claim 7 wherein the dispensing opening has a flat lower edge and generally vertical, lateral edges extending upward from later extremities of the central section of the bottom wall where it intersects the front wall.

9. The apparatus of claim 8 further comprising spaced openings in the bottom wall for permitting ice cubes to fall through the spaced openings for chilling a cold plate mounted beneath the bottom wall.

10. The apparatus of claim 8 further comprising a rotatable shaft having a rearward end mounted on the rear wall and having a forward end mounted near the front wall, and turning means connected to the shaft for turning the shaft.

11. The apparatus of claim 10 where said rotatable shaft further comprises a coil having spirals which taper from one end to a second end, wherein wire forming larger spirals becomes straightened towards the second end.

12. The apparatus of claim 11 wherein said smaller spiral is formed with flat wire, whereby said smaller spirals are bladelike further urging a maximum amount of ice towards the dispensing opening.

13. The apparatus of claim 10 wherein a rearward end of the shaft is mounted in a journal bearing on the rear wall and wherein the means for turning comprises a driving means connected to a forward end of the shaft.

14. The apparatus of claim 13 wherein the shaft slopes upward from the rear wall.

15. The apparatus of claim 14 wherein the rear wall has a lower portion which slopes inward generally perpendicular to the shaft.

16. The apparatus of claim 10 further comprising radial extensions mounted at spaced intervals along the shaft, the radial extensions being relatively long near the rearward end of the shaft and uniformly diminishing to relatively short radial extensions, and a stainless steel rod bent in a helical shape with overall generally conical dimensions forming continuously connected flytes having a genreally large radius near a rearward end of the shaft and having generally smaller radii as the flytes extend along the shaft.

17. The apparatus of claim 16 further comprising a solid, helical auger having generally oppositely radially extending flytes mounted on the shaft adjacent the forward end.

18. The apparatus of claim 17 wherein the rod closely approaches the central section of the bottom wall.

19. An ice storage bin in an ice dispenser has a rear wall, a front wall, and side walls which are connected to the rear and front walls and a cover means which rests atop the rear, front and side walls and a bottom wall extending between the rear wall, front wall and side walls, the bottom wall extending from the rear wall to the front wall, and the bottom wall having a depressed central section with a relatively large depression near the rear wall and a relatively small depression near the front wall, and a dispensing opening in the bin for dispensing ice stored within the bin.

20. The apparatus of claim 19 wherein the central section has a relatively large radius of curvature near the rear wall and a relatively small radius of curvature near the front wall.

21. The apparatus of claim 19 wherein the bottom wall has lateral portions with generally uniform radii of curvature which extend from the central section to the side walls.

22. The apparatus of claim 21 wherein the bottom wall is sloped.

23. The apparatus of claim 22 wherein the central section forms a larger obtuse angle with a plane of the front wall and wherein the lateral portions form lesser obtuse angles with a plane of the front wall.

24. The apparatus of claim 19 wherein the bottom wall has a curved central depression.

25. The apparatus of claim 24 wherein the depression is larger at the rear wall and smaller at the front wall.

* * * * *